United States Patent [19]

Laudig et al.

[11] 4,192,566

[45] Mar. 11, 1980

[54] ANTENNA LEAD SPLICE

[75] Inventors: Ronald C. Laudig, Mechanicsburg; John A. Morelli, Harrisburg, both of Pa.

[73] Assignee: AMP Incorporated, Harrisburg, Pa.

[21] Appl. No.: 972,758

[22] Filed: Dec. 26, 1978

[51] Int. Cl.[2] ..... H01R 25/00

[52] U.S. Cl. ..... 339/47 R; 174/91; 339/91 R; 339/211

[58] Field of Search ..... 339/47 R, 49 R, 91 R, 339/103 M, 198 P, 211, 217 S, 217 PS, 221 R, 256 R; 174/91

[56] References Cited

U.S. PATENT DOCUMENTS

| | | | |
|---|---|---|---|
| 397,553 | 2/1889 | Johnston, Jr. | 339/49 R X |
| 2,838,739 | 6/1958 | Winkler | 339/211 X |
| 3,011,143 | 11/1961 | Dean | 339/49 |

*Primary Examiner*—Roy Lake
*Assistant Examiner*—DeWalden W. Jones
*Attorney, Agent, or Firm*—Gerald K. Kita

[57] ABSTRACT

The disclosure relates to intermatable connector bodies for splicing coaxial cables. Each connector body is identical with the other and includes an outer conductive sleeve providing an outer receptacle and an outwardly projecting tongue which is intermatable with the outer receptacle of the other connector body. The outer shell of each connector body contains a dielectric having a coaxial bore in which is mounted a sleeve form inner receptacle provided with a projecting crimp sleeve which is secured, by crimping, to a coaxial cable center conductor which passes through the inner receptacle. Each inner receptacle matingly receives the crimping sleeve of another receptacle to establish an electrical splice of the respective center conductors of a pair of coaxial cables.

5 Claims, 6 Drawing Figures

ANTENNA LEAD SPLICE

FIELD OF THE INVENTION

The invention relates generally to a connector for splicing coaxial cables, and more particularly to a splice for coaxial cables which includes two intermatable hermaphroditic connector bodies capable of quick disconnect from each other.

BACKGROUND OF THE INVENTION

It is often desired to extend a coaxial cable of an antenna. To do so requires a coaxial extension cord which provides a remote electrical connection to the center conductor of the antenna cable or lead, which is isolated from another electrical connection to the shielding layer or sheath of the antenna lead. The connector is required to be low in cost and waterproof and of relatively small size for use in automobile radio applications. The splice according to the present invention is also useful for any application which requires a low cost coaxial extension cord, such as, for extending a coaxial instrument lead to connect with remote equipment.

According to the invention the splice includes a pair of intermatable connector bodies which are hermaphroditic, of compact size and relatively low in cost. Each connector body includes an outer metal shell which is secured by crimping to the outer conductive sheath of a coaxial cable. The shell encircles and contains thereby a dielectric insert provided with a coaxial bore therethrough. Internally of the bore is mounted a sleeve form metal receptacle having a split barrel section projecting outwardly of the dielectric insert. The coaxial cable is trimmed to expose a length of center conductor which projects through and along the interior of the receptacle and into the split barrel which is secured by crimping to the center conductor. Each split barrel section is matably received in a receptacle of the other connector body. Additionally, when the connector bodies are intermated, each metal shell includes a projecting tongue which matingly registers within an outer receptacle provided in the metal shell of the other connector body. To complete the assembly a separate plastic shell is received over the intermated connector bodies to provide a waterproof cover.

An object of the present invention is to provide a low cost, small size, quick disconnect splice for coaxial cables.

Another object of the present invention is to provide a quick disconnect splice for coaxial cables in the form of two identical intermatable connector bodies each having an outer metal shell providing an outer receptacle for matingly receiving a portion of the other connector body, each connector further including a center contact which is joined to a coaxial cable center conductor and which matingly receives at least a portion of the other center contact when the connector bodies are intermated.

Other objects and advantages of the present invention will become apparent from the following detailed description taken in conjunction with the accompanying drawings.

DRAWINGS

DETAILED DESCRIPTION

Figures 1, 2, 3:
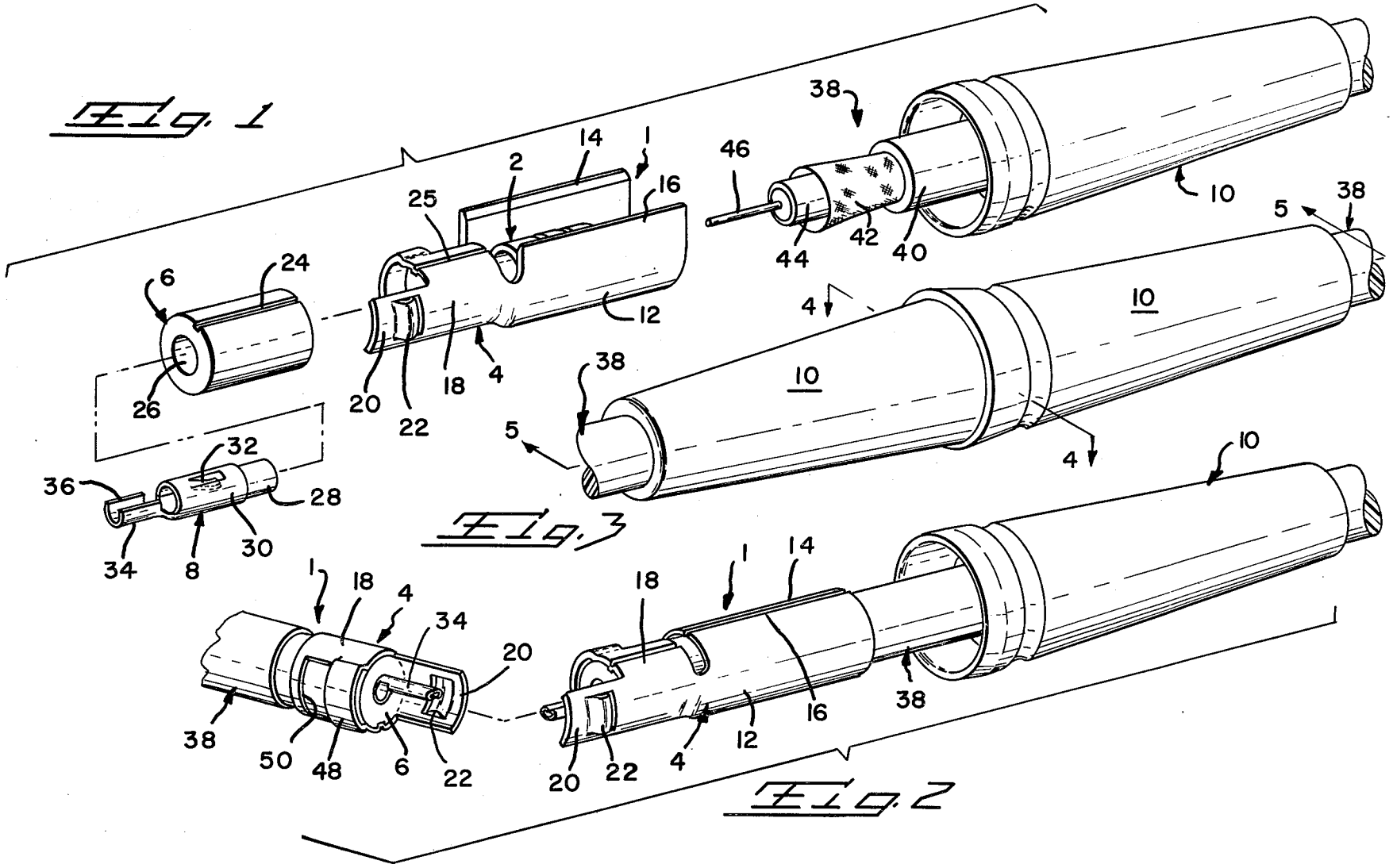
FIG. 1 is an enlarged fragmentary perspective with parts in exploded configuration illustrating the details of a connector body of a coaxial splice according to the present invention.
FIG. 2 is an enlarged fragmentary perspective of the connector body shown in FIG. 1 in assembled configuration, and illustrated in conjunction with an identical assembled connector body prior to intermating engagement therewith.
FIG. 3 is an enlarged fragmentary perspective of a coaxial splice according to the present invention within a waterproof casing.

With more particular reference to the drawings, FIGS. 1 and 2 illustrate a connector body generally at 1 which is intermatable with another identical connector body to provide a coaxial splice. FIG. 1 illustrates the details of the component parts of the connector body, including a rigid metal sleeve 2, an outer conductive shell of metal 4, a dielectric insert 6, a metal center contact 8, and a stiffly resilient dielectric casing 10.

The shell 4 is of one piece construction and includes a split sleeve or barrel portion 12 having an initially open side defined between a pair of longitudinal edge margins 14 and 16. The shell 4 further includes a cylindrical portion 18 open at opposite ends and adapted to intimately encircle the cylindrical periphery of the dielectric insert 6 which is axially slideably interfit within the cylindrical portion 18. Further, the one piece shell 4 includes a segmented arcuate tongue portion 20 which projects axially of the shell 4. A central section of the tongue 20 is formed with a latching tab 22 which is partially severed from the tongue portion 20 and is partially doubled back upon itself to project outwardly of the plane of the tongue 20.

The dielectric insert 6 is provided on its outer periphery with an axial keyway groove 24 which may be aligned with a key 25 indented into the inner periphery of the cylindrical section 18. The insert 6 further includes a coaxial bore 26 therethrough. The bore 26 is of stepped configuration to intimately encircle the stepped cylindrical periphery of the center contact 8.

The contact 8 includes a reduced cylindrical portion 28. The contact 8 further includes a central enlarged diameter section 30 which provides an electrical receptacle. A resilient tab 32, which is formed by partially severing away from the outer periphery of the section 30, is formed or bent to project into the cylindrical interior of the receptacle 30. The contact 8 further includes an integral split barrel section or split sleeve section 34, initially open along one side 36. The split barrel section 34 is substantially offset radially from the central axis of the receptacle section 30 so as not to obstruct the open end thereof. The contact 8 is axially slideably interfit within the stepped bore 26 of the insert 6, with the split sleeve section 34 projecting outwardly of the insert 6 and outwardly of the cylindrical portion 18 of the shell 4.

With reference to FIG. 1 a coaxial cable is illustrated generally at 38 and includes an outer sheath of dielectric 40 covering a conductive sheath or layer 42, which may be fabricated of a braided metal mesh. Beneath the layer 42 is provided a layer of dielectric material 44 which is coaxially received over an elongated center conductor 46. An end of the cable to be spliced has the various coaxial layers trimmed, as shown, in order to expose a length of center conductor and dielectric layer 44 and conductive sheath 42.

To assemble a connector body to the trimmed cable reference is made to FIG. 1. Initially the tapered cylindrical casing or boot 10 is slipped over the cable 38. The rigid sleeve 2 is then inserted coaxially between the dielectric layer 44 and the conductive sheath or layer 42. The cable is then inserted into and along the shell 4.

Figure 5:
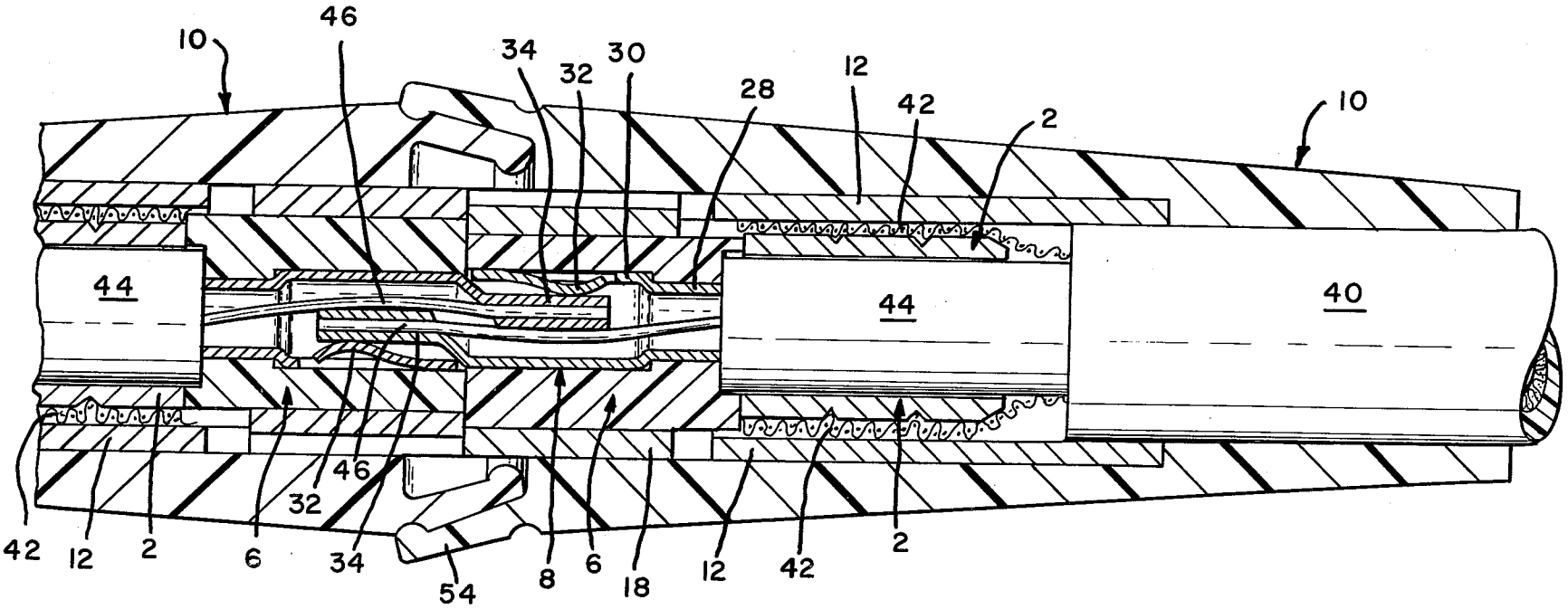
FIG. 5 is an enlarged fragmentary section of a portion of the device shown in FIG. 3 taken along the line 5—5.
Figure 6:
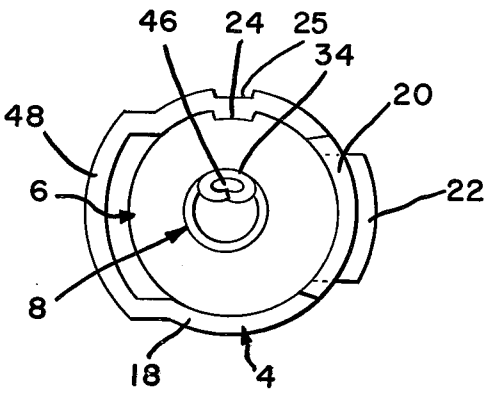
FIG. 6 is an enlarged end elevation of an assembled connector body.

FIGS. 1 and 5 more particularly illustrate the cable 38 within the connector body 1. More specifically, the conductive sheath 42 is received between the metal sleeve 2 and the shell section 12, which is closed to encircle the conductive sheath 42 by bringing the edges 14 and 16 toward each other during a closing and crimping operation. FIG. 2 illustrates a longitudinal seam being provided between the cooperating closed edges 14 and 16. The shell section 12 therefore becomes substantially cylindrical and is radially compressed during the crimping operation to grip the conductive layer 42 against the sleeve 2 and provide an electrical connection therewith.

FIG. 5 additionally illustrates the elongated center conductor 46 projecting through the receptacle section 30 of the metal contact 8 from one open end thereof to the other. Further the conductor 46 is received axially along the split barrel section 34 which is then closed and crimped cylindrically to encircle the conductor 46. The closed configuration of a split sleeve section 34 is radially crimped to grip the conductor and establish an electrical connection therewith.

FIG. 5 illustrates also the intermating of one connector body with another to provide a splice connection for a pair of coaxial cables 38. To establish electrical continuity of one center conductor 46 with the center conductor of the other cable, the connector bodies are intermated by receipt of one center contact 8 within the other. More specifically, the split sleeve section 44, together with the center conductor 46 which is connected therein, is inserted into the receptacle section 30 of the other center contact 8. Accordingly each receptacle portion 30 has sufficient interior space to receive the split sleeve section of the other contact as well as both conductors 46. Also, during mating together of the connector bodies, the split sleeve sections 34 are offset laterally from the receptacle sections 30, so that the sleeve sections 34 are allowed to pass each other and enter into the corresponding receptacle sections. Once received within a corresponding receptacle section 30, each split sleeve section 34 is resiliently engaged by a corresponding resilient tab portion 32 to establish an electrical connection. As shown more particularly in FIGS. 2 and 4, each portion 18 of a shell portion 4 includes a radially enlarged segment 48 defining an annular space between itself and the outer periphery of the dielectric insert 6. An outer electrical receptacle provided is thereby into which the tongue 20 of the other connector body is interfitted, when the connector bodies are intermated. The interfitted tongue portion thereby makes a mechanical and electrical connection within the outer receptacle of the other connector body. In addition, each connector body section 18 has a segmented portion 50 thereof removed to provide a space for receiving a tongue portion 20 of the other connector body. The space is in tandem alignment with the receptacle portion. A tongue portion 20 covers the space 50. A resilient locking tab 22 will pass through the space provided by shell portion 48 and will latchably engage behind the same to aid in retention of the intermated connector bodies. The tab 22 will have an interference fit with the shell portion 48.

Figure 4:
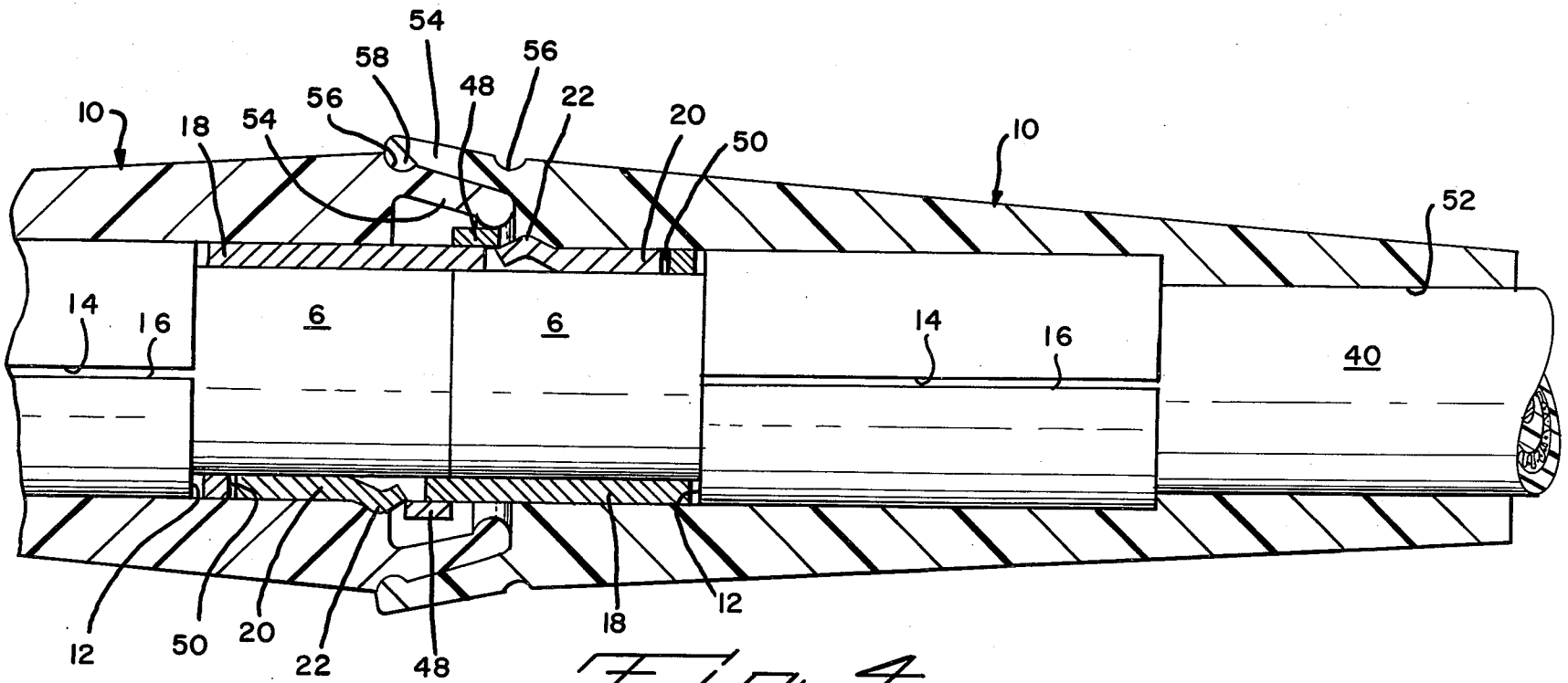
FIG. 4 is an enlarged longitudinal section of a portion of FIG. 3 taken along the lines 4—4.

FIG. 4 further illustrates the details of the outer casing or boot 10. Each boot 10 includes a cylindrical open end 52 which is radially flexible to intimately encircle the cable sheath 40. The opposite open end includes a radially spaced, stiffly flexible lip 54 having an outer circular groove 56 at the intersection of the lip with the remainder of the boot. The internal periphery of the lip 58 is formed with an enlarged rounded bead. Two boot portions 10 are initially brought together until their corresponding lips 54 engage and become, thereby, forced to deflect such that one of the lips will overlie the other. The bead 58 of the overlying lip will register within the groove 56 of the other, thereby to latch the boots together. Both sections of the boot may be unlatched from each other by pulling them apart with sufficient force to overcome the latching relationship. The connector bodies may also be disconnected by pulling them apart with sufficient force to overcome the frictional retention of the respective inner receptacle and outer receptacles.

Although a preferred embodiment of the present invention is disclosed and described in detail, other modifications and embodiments thereof which would become apparent to one having ordinary skill in the art are intended to be covered by the spirit and scope of the claims.

What is claimed is:

1. A pair of intermatable connector bodies for splicing the ends of electrical coaxial cable, comprising:

an outer one piece metal shell of each connector body having a split barrel portion encircling and radially crimped on a corresponding coaxial cable to be spliced, each said shell having a closed barrel portion and a dielectric insert received therein, each said shell including a cavity between said closed barrel portion and a portion of said dielectric insert defining an outer receptacle, each said insert having a coaxial bore and a metal center contact received in said bore, each said center contact having an open ended sleeve section and a split barrel section projecting outwardly of a corresponding said insert, said conductor projecting within and along said sleeve section and being secured in said split barrel section, said sleeve section being larger in diameter than said corresponding conductor to define an inner receptacle matingly receiving the split barrel section of the other connector body, and each said shell having an elongated tongue portion projecting outwardly beyond said split barrel portion and matably received in said outer receptacle of the other connector body.

2. A connector having a pair of intermatable connector bodies for splicing two coaxial cables end to end, the combination comprising:

each connector body including an outer metal shell connected to a conductive sheath of said cable, each said shell intimately encircling a dielectric insert which intimately encircles a metal contact having a sleeve form receptacle and a split barrel section projecting outwardly of said receptacle, a center conductor of each cable to be spliced projecting along an interior of a corresponding said receptacle and being secured to said split barrel section, each said center conductor together with a corresponding said split barrel section being matably received in a said receptacle of the other connector body, and each said metal shell including a projection which matingly registers against said metal shell of the other connector body.

3. The structure as recited in claim 2, wherein, each said metal shell includes an outer receptacle formed adjacent a portion of the periphery of said insert, and each said metal shell includes a tongue portion projecting outwardly for mating registration in said outer receptacle of the other connector body.

4. The structure as recited in claim 3, wherein, each tongue portion includes a partially severed away portion which provides a resilient locking tab for resilient interference fit into a corresponding said receptacle of the other connector body.

5. The structure as recited in claim 2, wherein, each said sleeve form receptacle includes a partially severed away tab which projects internally of said receptacle and resiliently engages adjacent said split barrel section of the other connector body.

* * * * *